United States Patent [19]

Figiel et al.

[11] Patent Number: 4,476,036

[45] Date of Patent: Oct. 9, 1984

[54] QUATERNARY 1,1,2-TRICHLORO-1,2,2-TRIFLUORO AZEOTROPIC CLEANING COMPOSITION

[75] Inventors: Francis J. Figiel, Morris; Aaron Colbert, Essex, both of N.J.

[73] Assignee: Allied Corporation, Morris Township, Morris County, N.J.

[21] Appl. No.: 531,323

[22] Filed: Sep. 12, 1983

[51] Int. Cl.[3] ..... C11D 7/26; C11D 7/30; C11D 7/50; C23G 5/02

[52] U.S. Cl. ..... 252/171; 134/31; 134/40; 252/170; 252/172; 252/364; 252/DIG. 9; 203/56; 203/66; 203/67; 203/68

[58] Field of Search ..... 252/170, 171, 364, 172, 252/DIG. 9; 134/31, 40; 203/56, 66, 67, 68

[56] References Cited

U.S. PATENT DOCUMENTS

| | | | |
|---|---|---|---|
| 2,999,817 | 9/1961 | Bower | 252/172 |
| 3,400,077 | 9/1968 | Orfeo et al. | 252/171 |
| 3,607,767 | 4/1971 | Schofield | 252/171 |

*Primary Examiner*—Dennis L. Albrecht
*Attorney, Agent, or Firm*—Arthur J. Plantamura; Jay P. Friedenson

[57] ABSTRACT

Quaternary azeotropic mixtures of 1,1,2-trichloro-1,2,2-trifluoroethane, methylene chloride, methanol and cyclopentane are provided. These azeotropic mixtures are useful as solvents to remove buffing compounds residues. These mixtures are useful not only because of their high solvency characteristics but also because they exhibit essentially the constant boiling characteristics of an azeotrope which is formed between these components, thereby facilitating handling and purification of the solvent mixtures without significantly altering their compositions. [The quaternary mixtures disclosed herein exhibit certain advantageous solvency characteristics of glycol based compositions, over the known binary or ternary azeotropic systems containing 1,1,2-trichloro-1,2,2-trifluoroethane, methylene chloride, methanol and cyclopentane.]

5 Claims, No Drawings

QUATERNARY 1,1,2-TRICHLORO-1,2,2-TRIFLUORO AZEOTROPIC CLEANING COMPOSITION

BACKGROUND OF THE INVENTION

This invention relates to azeotropic compositions and particularly to quaternary mixtures of trichlorotrifluoroethane, methylene chloride, methanol and cyclopentane.

The electronic industry with its highly diversified needs has sought solvents which can effectively remove rosin fluxes from printed circuit boards and remove emulsion residues from computer aluminum discs prior to coating. In both instances, removal of these impurities is essential to achieve maximum reliability of the printed circuit's assembly and computer systems. The solvent used for cleaning surfaces must not only be highly effective for removing the undesired residues but must, for commercial applications, be stable, nonflammable and be compatible with electronic components and material of construction (aluminum, e.g.). In addition, where possible the solvent mixtures should desirably form an azeotrope; a constant boiling mixture which should remain stable under vapor degreasing conditions.

Several of the chlorofluoroethanes have attained widespread use as specialty solvents in recent years, in particular trichlorotrifluoroethane has become widely used. This compound is a relatively low boiling liquid ($CCl_2FCClF_2$, 47.6° C.), which is nontoxic and nonflammable, and which has satisfactory solvent power for greases, oils and the like. It has therefore found frequent use for cleaning electronic hardware and other substrates including electric motors, compressors, photographic film, lithographic plates, instruments, gauges, sound tape, and a variety of other substrates, often of the kind where aqueous cleaning mixtures are preferably avoided.

In cleaning printed circuit boards, various prior art solvent cleaning mixtures are presently recognized as effective agents; but in the area of removal of buffing compounds from memory discs, they suffer from at least the following disadvantage: they are not miscible with the chemicals to be removed; have poor wetting abilities; limited penetration; and inadequate washability to remove particulate contaminants from crevices. Other disadvantages in prior art mixtures occur, for example, where highly chlorinated solvents such as 1,1,1-trichloroethane are used. Although effective in wetting residue, these solvents hydrolyze in the presence of moisture and white metal substrates, forming hydrochloric acid, a highly corrosive chemical.

A number of binary as well as ternary azeotropic (constant boiling) mixtures have been employed for the purpose of cleaning electronic hardware which afford many of the advantages obtainable with solvent mixture. Illustrative of such azeotropic systems are the azeotrope of 1,1,2-trichlorotrifluoroethane and methylene chloride, (disclosed in U.S. Pat. No. 2,999,817); the ternary system trichlorotrifluoroethane, methyl alcohol and methylene chloride (disclosed in U.S. Pat. No. 3,400,077) and the ternary system of 1,1,2-trichloro-1,2,2-trifluoroethane, methylene chloride and cyclopentane (disclosed in U.S. Pat. No. 3,607,767). However, the solvencies of these binary or ternary compositions are less than desired and the solvents leave deposits on aluminum discs.

A need therefore exists for a cleaning composition of improved solvency and compatibility particularly in cleaning memory discs-aluminum substrates prior to coating.

In particular, a need exists for a cleaning composition which mixes readily, and dissolves and floats residues of buffing material (typically an emulsion comprised of oil, surfactant, water-glycol and particulates). Thus, the solvent mix must contain a hydrocarbon solvent to dilute the glycol based buffing material and to float particulates; an aliphatic alcohol to wet hydrophylic surfaces; a strong solvent to cut oily, greasy residues; a solvent having vapors six times heavier than air to minimize the diffusion rate of the other solvent vapors; impact stability and safety (non-flammability). Such mixture exhibits greater solvency power and greater wettability of hydrophobic and hydrophylic surfaces. This is important where emulsion type buffing compound residues need to be removed from aluminum discs, lenses and glass molds.

SUMMARY OF THE INVENTION

In accordance with the invention, it has been found that distinctly advantageous results are obtainable with a novel azeotropic composition consisting essentially of a quaternary mixture of 1,1,2-trichloro-1,2,2-trifluoroethane, methylene chloride, cyclopentane and methanol.

We have found that a quaternary azeotropic mixture is formed by blending approximately 44 to 48 weight percent 1,1,2-trichloro-1,2,2-trifluoroethane, approximately 42 to 47 weight percent methylene chloride, approximately 4.5 to 5.5 cyclopentane and approximately 4.0 to 4.5 weight percent methanol. The mixture boils at about 33.5° C. at 760 mm and affords distinctly advantageous results.

We have discovered that this azeotropic mixture is non-flammable, inert and otherwise safe and convenient to use and that it exhibits unusually high cleansing ability in removing buffing compositions. As a consequence, samples of the novel azeotropic composition may be employed repeatedly and effectively as solvents to cleanse substrates and leave no perceptible residues. Moreover, the solvent solutions remain clear even after repeated use. Since the azeotrope boils at a constant temperature, evaporation or distillation of the azeotrope in whole or in part does not change the composition of the liquid mixture. This is significant since it enables the azeotropic mixture to be handled and purified without the adverse effect of having its composition change as would occur with a non-azeotropic mixture.

DESCRIPTION OF THE PREFERRED EMBODIMENT

In accordance with the invention, a ternary azeotrope consisting of, 1,2-trichloro 1,2,2-trifluoroethane, 40 percent by weight, methylene chloride, 50.0 percent by weight, and technical grade cyclopentane, 10.0 percent by weight, was utilized with the addition of anhydrous methanol at 95.0 percent by weight of the ternary azeotrope and 5.0 percent by weight of the methanol.

The above mixture was distilled and based on the observation of the constant boiling point of the vapor phase the existence of an azeotrope was confirmed.

The boiling points for the four cuts ranged between 33¼° and 33½° C. and the density between 1.260 and 1.2615 g/cc at 24° C.

PROCEDURE

The distillation apparatus employed comprises of a round bottom, three neck 5000 ml flask and four plate condensor with a distillation head and an ASTM calibrated thermometer. The distillation process consists of refluxing the solvent mixture for about an hour, then collecting up to six distillation cuts, discarding the first and the last, and analyzing the composition of each cut by the gas chromatographic method, using in final work, standard mixtures prepared particularly for this work and converting the area measurements to weight percent. Solvents used for this work were high purity A.C.S. grade products as well as technical grade.

Although the azeotropes are obtained at approximately 760 mm. Hg pressure, normal variations are to be expected and, therefore, a variation in pressure and consequently a change in the composition and boiling point is also intended to be included within the scope of this invention. Thus, the azeotropes may contain some variation in proportions of the four components, provided that, a constant boiling mixture is obtained at the various pressures at which the compositions are used. Stated otherwise, any pressures may be used to obtain the azeotropes of this invention so long as the four component system comprising trichlorotrifluoroethane, methylene chloride, cyclopentane and methyl alcohol is employed. Accordingly, the ratios of these components will vary within the normal limits contemplated by those skilled in the art for azeotropic systems. The variation of the proportions of components is thus within the skill of the art once it is known that the compositions will form azeotropes. In a preferred embodiment, the present invention relates to the azeotropic mixture of 1,1,2-trichloro-1,2,2-trifluoroethane, methylene chloride, cyclopentane and methanol at atmospheric pressure. The cyclopentane may be pure or contain up to about 5 or about 10 percent by weight of about 4 to about 7 carbon atom homologues or analogues and substantially the same results obtained.

In the azeotrope 1,1,2-trichloro-1,2,2-trifluoroethane may be substituted in part or completely by 1,1,1-trichloro-2,2,2-trifluoroethane.

The variation range of the four components of the azeotropic mixture may generally be stated in weight percent as about 44% to 48% 1,1,2-trichloro-1,2,2-trifluoroethane, about 42% to 47% methylene chloride, about 4.5 to 5.5 percent cyclopentane and about 4.0 to 4.5 percent methanol.

The following examples illustrate preparation of the azeotropic composition of the invention, which is the preferred embodiments, and set forth the solvency properties exhibited by the same. It will be understood that although these examples may describe in detail certain preferred operating conditions of the inventions, they are given primarily for purposes of illustration and the invention in its broader aspects is not limited thereto.

In each of the examples the distillation procedure described above was employed wherein the first and last cuts were discarded and a composite of the next four cuts was analyzed.

Approximately 1.0% by weight of nitromethane was added to the systems to determine the possibility of forming a quintinary azeotrope. A pure grade cyclopentane 16551 (obtained commercially) gave similar results as the technical grade cyclopentane as evidenced by Examples I and III.

EXAMPLE 1

| | Weight Percent |
|---|---|
| Methylene Chloride | 44.2–45.7 |
| Cyclopentane T Grade | 4.9–5.2 |
| Methyl Alcohol | 4.1–4.2 |
| Trichlorotrifluoroethane | 45.3–46.4 |

Distillation Rate - 11.5 cc/1 minute
Distillation Temperature - 33.7° C.
Barometric Pressure - 742.6 mm Hg
Nitromethane was added to the mixture but it did not show up in the distillate indicating that an azeotrope does not form with nitromethane.

EXAMPLE II

| | Weight Percent[1] |
|---|---|
| Methylene Chloride | 44.2–45.7 |
| Cyclopentane 16551[2] | 4.9–5.2 |
| Methyl Alcohol | 4.1–4.2 |
| Trichlorotrifluoroethane | 45.3–46.4 |

Distillation Rate - 7.6 cc/1 minute
Distillation Temperature - 34° C.
Specific Gravity - 1.318 at 74° C.
Barometric Pressure - 756.2 mm Hg

[1]Weight percent data indicate the range within which the composition of each distilation cut falls.
[2]Obtained from Eastman Kodak Company.

EXAMPLE III

| | Weight Percent |
|---|---|
| Methylene Chloride | 43.0–43.7 |
| Cyclopentane T Grade | 5.0–5.3 |
| Methyl Alcohol | 4.1–4.3 |
| Trichlorotrifluoroethane | 47.0–47.5 |

Distillation Rate - 11.0 cc/1 minute
Distillation Temperature, boiling point of the mixture - 33.5° C. at barometric pressure of 755.0 mm Hg
Specific Gravity - 1.308 at 72°
Flash Point (Tag Closed Cup ASTM) - Negative The solvency power of the composition of the invention is indicated by the values set forth in Table I.

TABLE I

Kauri-Butanol Numbers ASTM D-1133

| Component | Kauri-Butanol Value* |
|---|---|
| Trichlorotrifluoroethane and Methylene Chloride | 85 |
| Methylene Chloride and Cyclopentane | 98 |
| Methylene Chloride and Methyl Alcohol | 125 |
| Trichlorotrifluoroethane and Methylene Chloride Methyl Alcohol Cyclopentane | >145 |

*The values may vary from one analyst to another because of the nature of the test.

It is thus seen that the described azeotropic-like composition comprising about 45.5 weight percent of 1,1,2-trichloro-1,2,2-trifluoroethane, about 45.0 weight percent methylene chloride, about 5.2 weight percent cyclopentane and about 4.3 weight percent methanol affords uniquely desirable characteristics in its cleansing of various substrates.

Stability of a halogenated solvent mixture can be established by testing for chloride ion. The chloride content is undisolved because these solvents may or may not hydrolyze depending on the nature of the organic solvents, presence of an inhibitor, nature of contaminants and the substrate to be cleaned. Establishing the stability of the novel composition following experimental work is carried out as follows.

EQUIPMENT

Hot plate, 250 ml Erlenmeyer flasks with Allihn condensers, aluminum alloy strips and sludge. The sludge is an emulsion type buffing compound (glycol, metallic dust and oil).

METHOD

Erlenmeyer flasks were charged with about 100 ml of the novel mixture, (45.5 parts of 1,1,2-trichloro-1,2,3 trifluoroethane, 45 parts methylene chloride, 5.2 parts of cyclopentane and 4.3 parts of methanol, by a weight basis) aluminum strips were inserted so that part of them were, immersed in the solvent and part exposed to vapors, and 1 g of sludge was added. Six flasks, times five, were set up:

1. Blank (only the novel composition)
2. Novel composition plus Al-strip
3. Novel composition plus Al-strip and sludge
4. Novel composition plus Al-strip, sludge and water
5. Novel composition plus sludge
6. 1,1,1-trichloroethane plus Al-strip and sludge.

The samples thus prepared were now refluxed for eight to 4×24 hour. Chloride analyses were carried out after eight hours and after every additional 24 hours. Any changes of the coupons were observed. The Table II shows the results.

The novel composition, even in the presence of moisture, showed greater stability than 1,1,1-trichloroethane and did not attack the aluminum strip at the interface.

TABLE I

| Sample No. | Components | Controlled Tests Cl-Analysis (ppm) 8 Hr. | 24 Hr. | 48 Hr. | 72 Hr. | 96 Hr.[1] |
|---|---|---|---|---|---|---|
| 1A | (a) Azeotrope Composition + Al | 1.0 | | | | |
| 2A | | | 1.0 | | | |
| 3A | | | | 1.9 | | |
| 4A | | | | | 1.0[2] | |
| 5A | | | | | | 1.0 |
| 6A | (a) Azeotrope Composition + Al + Sludge | 1.4 | | | | |
| 7A | | | 1.6 | | | |
| 8A | | | | 1.6[2] | | |
| 9A | | | | | 5.4[2] | |
| 10A | | | | | | 2.2 |
| 11A | (a) Azeotrope Composition + Al + Sludge + $H_{20}$ | 4.5 | | | | |
| 12A | | | 4.5 | | | |
| 13A | | | | 6.3 | | |
| 14A | | | | | 6.3 | |
| 15A | | | | | | 5.5 |
| 16A | (a) Azeotrope Composition + Sludge | 1.0 | | | | |
| 17A | | | 1.6 | | | |
| 18A | | | | 1.3[2] | | |
| 19A | | | | | 1.3 | |
| 20A | | | | | | 1.5 |
| 21A | (a) Azeotrope position | — | 0.8 | | | |
| 21B | | | | 0.5 | | |
| 21C | | | | | 0.5 | |
| 21D | | | | | | 1.1 |
| 22A | (1,1,1)[3] + Al + Sludge | — | 10.6 | | | |
| 23A | | | | — | 4.3 | |
| 24A | | | | | | 6.5 |
| Blank | Sludge | 0.2 ppm | | | | |
| Blank | DTA Novel Composition | 0.2 ppm | | | | |
| Blank | 1,1,1 | 1.8 ppm | | | | |

[1]Except for Sample Nos. 22A–24A, which exhibited a black scum at the vapor-liquid interface, no change was observed at 96 hours.
[2]These samples evaporated through loose joints almost to dryness. Volume made up fresh DTA Novel Composition.
[3]1,1,1-trichloroethane.

Although the invention has been described by reference to some preferred embodiment, it is not intended that the broad scope of the novel azeotropic compositions be limited thereby, but that certain modifications are intended to be included within the spirit and broad scope of the following claims.

What is claimed is:

1. An azeotropic mixture consisting essentially of about 44 to 48 parts 1,1,2-trichloro-1,2,2-trifluoroethane, about 42 to 47 parts methylene chloride, about 4.5 to 5.5 parts cyclopentane and about 4.0 to 4.5 parts methanol, said parts being on a weight basis.

2. An azeotropic mixture of atmospheric conditions consisting essentially of about 45.5 parts of 1,1,2-trichloro-1,2,2-Trifluoroethane, about 45 parts methylene chloride, about 5.2 parts cyclopentane and about 4.3 parts methanol, said parts being on a weight basis.

3. A method of cleaning a surface by contacting said surface with an azeotropic mixture consisting essentially of about 42 to 47 parts 1,1,2-trichloro-1,2,2-trifluoroethane, about 42 to 47 parts methylene chloride, about 4.5 to 5.5 parts cyclopentane and about 4.0 to 4.5 parts methanol on a weight basis at a boiling temperature of about 33°–34° C. at about 760 mm Hg pressure.

4. A method according to claim 3 as applied to the removal of buffing compositions from a work piece surface.

5. A method according to claim 3 wherein the surface to be cleansed is that of an aluminum memory disc.

* * * * *